US005857027A

United States Patent [19]

Gaidarov et al.

[11] Patent Number: 5,857,027

[45] Date of Patent: Jan. 5, 1999

[54] LOUDSPEAKER

[76] Inventors: Alexandr Sergeevich Gaidarov, 142717, Moscow, obl., pos. Razvilka, d. 25, v.35; Alxei Vladimir Vinogradov, 127486, Moscow, Dmitrovskoe shosse, d.89, korp.1, kv.9i, both of Russian Federation

[21] Appl. No.: 596,167

[22] PCT Filed: Aug. 5, 1994

[86] PCT No.: PCT/RU94/00184

§ 371 Date: Apr. 15, 1996

§ 102(e) Date: Apr. 15, 1996

[87] PCT Pub. No.: WO95/05057

PCT Pub. Date: Feb. 16, 1995

[30] Foreign Application Priority Data

Aug. 6, 1993 [RU] Russian Federation ..... 930038132

[51] Int. Cl.[6] ..... H04R 25/00

[52] U.S. Cl. ..... 381/182; 381/188; 381/205; 381/24; 381/160

[58] Field of Search ..... 381/182, 188, 381/205, 24, 160, 152, 64, 66, 89

[56] References Cited

U.S. PATENT DOCUMENTS

| | | | |
|---|---|---|---|
| 3,608,665 | 9/1971 | Drisi . | |
| 3,715,008 | 2/1973 | Lover . | |
| 3,759,345 | 9/1973 | Borisenko . | |
| 5,253,301 | 10/1993 | Sakamoto et al. | 381/188 |
| 5,526,456 | 6/1996 | Heinz | 381/182 |

FOREIGN PATENT DOCUMENTS

| | | |
|---|---|---|
| WO 93/22889 | 11/1993 | European Pat. Off. . |
| 2 466 930 | 4/1981 | France . |
| A1 2466930 | 4/1981 | France . |
| 2 679 095 | 1/1993 | France . |
| B2 57-31350 | 7/1982 | Japan . |
| 1756934 A1 | 8/1992 | Russian Federation . |
| 1809937 A3 | 4/1993 | Russian Federation . |
| 1809938 A3 | 4/1993 | Russian Federation . |
| 1174415 | 12/1969 | United Kingdom . |
| 2 063 008 | 5/1981 | United Kingdom . |
| WO 93/22889 | 11/1993 | WIPO . |

*Primary Examiner*—Curtis A. Kuntz
*Assistant Examiner*—Rexford Barnie
*Attorney, Agent, or Firm*—Knobbe, Martens, Olson & Bear, LLP

[57] ABSTRACT

The loudspeaker particularly comprises two-aperture radiator (1) containing paired in-phase counter-radiating apertures (4) and reproducing middle frequencies. Apertures (4) face each other, and their geometrical axis F is positioned vertically, while the distance between apertures (4) equals to at least the radius of aperture (4) but does not exceed the wavelength of the lowest frequency reproduced by paired apertures (4).

6 Claims, 1 Drawing Sheet

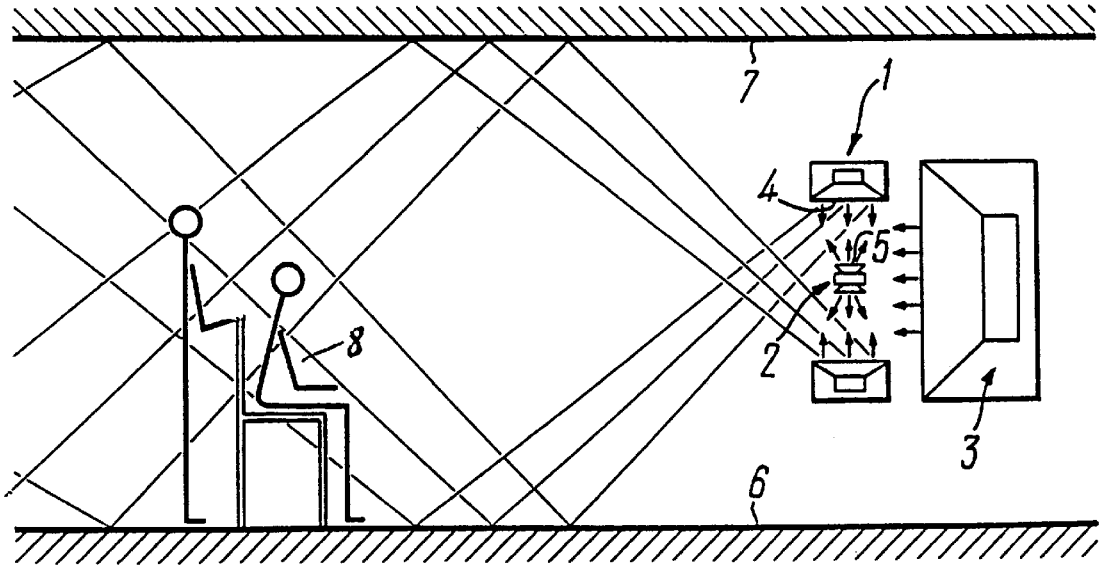
7
1
4
5
2
8
3
6

LOUDSPEAKER

FIELD OF TECHNOLOGY

This invention relates to the field of electroacoustics and specifically concerns loudspeakers.

PRIOR ART

A loudspeaker is known which comprises 2N (where N≧3) transducer heads connected in-phase and located in a horizontal plane in pairs and coaxially, one in front of the other, with the equally increased distance between the paired heads toward the listener (SU, A, 936462).

The above loudspeaker does not provide voluminosity and directivity of sound.

A loudspeaker is known which comprises three two-aperture radiators, each containing a pair of identical coaxial in-phase counter-radiating apertures (U.S. Pat. No. 4,182, 931).

This structure of the loudspeaker features an increased irregularity of frequency response, vertical direction of radiation and an insufficient "effect of presence".

Identical in-phase counter-radiating apertures are hereinafter understood as radiators of equal geometry (indiscernible within the perception thresholds), equal acoustic characteristics and in-phase radiation of apertures.

DISCLOSURE OF THE INVENTION

The invention is based on the task to develop a loudspeaker with a structure which allows to decrease irregularity of frequency response and radiation directivity in a vertical plane, providing an "effect of presence" prerequisites for which are provided for by two-aperture counter-radiation.

This is achieved by the fact that in a loudspeaker comprising at least one two-aperture radiator containing a pair of identical coaxial in-phase counter-radiating apertures in accordance with the invention the two-aperture radiator formed by a pair of identical coaxial in-phase counter-radiating apertures comprises apertures facing each other, their geometrical axes being vertical, whereas the distance between the apertures equals at least our, radius of the aperture but does not exceed the wavelength of the lowest frequency reproduced by the pair, and the two-aperture radiator reproduces at least middle-range frequencies.

In a loudspeaker additionally comprising a high-frequency band radiator with a pair of identical coaxial in-phase counter-radiating apertures these apertures may be located between the apertures of the middle-range frequency radiator coaxially and symmetrically, whereas the cross-section area of the high-frequency band radiator may ba equal to no more thin 0.7 of the radiation aperture area of the middle-range frequency radiator.

In a loudspeaker additionally comprising a low-frequency band radiator the latter may be located so that its acoustic axis is situated in a vertical plane running through the acoustic axis of tile loudspeaker.

This structure of the loudspeaker being claimed allows to improve the quality of sonification as far as voluminosity and the "effect of presence" are concerned. It also dramatically improves discernibility (articulation) of sound, its lucidity, providing a possibility to precept the sound of each instrument in the orchestra being in hall environment, Solution of the above task required results of investigations carried out in the field adjacent to technical acoustics: psychophysiology of sound perception.

An analysis of psychophysiological features of sound perception indicates that voluminosity of sonification is conditioned by both non-directivity of radiation and non-correlated noise containing the program signal. The main component of signal-correlated noise is intermodulation prevailing is loudspeakers as the Doppler intermodulation. The essence of the Doppler intermodulation is change of high-range frequency components by the membrane being displaced by low-frequency signals (the effect of changing whistle tone of train moving with respect to the listener).

To eliminate the Doppler component of intermodulation which is most noticeable in the middle-frequency range, the two-aperture radiator comprising two identical in-phase excited and facing each other apertures is connected to a middle-frequency source, while geometrical axis of its apertures is positioned vertically. This results in mutual compensation of Doppler intermodulation components of each aperture, while providing a circular directivity pattern in the horizontal plane.

The "effect of presence" is provided by reconstruction of spatial and temporal aspects of reverberation of the signal recorded by microphones and sound pickups located closely to the players, which signal bears no data on dimensions and reflection characteristics of the performance room.

The main reverberation component, mandatory in all cases, is formed by reflection of sound from the ceiling and the floor of the room. Reconstruction of this component is effected by the vertical axis of the middle-frequency (high-frequency) radiator through reflection from the ceiling and the floor of the room in the upper and the lower apertures of the middle-frequency (high-frequency) radiator.

Non-directivity of radiation in the horizontal plane is achieved, first, through positioning of the middle-frequency radiator in the same vertical plane with the acoustic axis of other band radiators Besides, to form a single radiation center and a circular directivity pattern in the horizontal plane while retaining spectral ratio in signals reflected from the ceiling and from the floor, the high-frequency apertures are situated coaxially with the middle-frequency apertures and symmetrically between them. To prevent high-frequency radiator dimensions overlapping a significant part of middle-frequency aperture radiation, its dimensional area must not exceed 0.7 of that of each of the middle-frequency radiator area. The distance between the middle-frequency apertures is determined, on the one hand by the absence of transverse standing waves, and on the other hand, by a possible use of longitudinal resonance for full realization of middle-frequency radiator potential range. For the same purpose, the low-frequency band radiator is located symmetrically with respect to the middle-frequency radiator along the acoustic axis of the loudspeaker.

BRIEF DESCRIPTION OF THE DRAWING

The invention is further elucidated by description of a specific example of its implementation and the attached drawing which depicts the general layout of the loudspeaker being claimed.

THE BEST MODE FOR CARRYING OUT THE INVENTION

The loudspeaker being claimed comprises two-aperture middle-frequency radiator 1, high-frequency band radiator 2, and low-frequency band radiator 3&

Middle-frequency radiator 1 comprises a pair of identical coaxial in-phase counter-radiating apertures 4. These apertures face each other, their geometric axes ape positioned vertically, and the distance between apertures 4 equals at least the radius of aperture 4 but does not exceed the wavelength of the lowest wave reproduced by apertures 4.

High-frequency band radiator 2 comprises a pair of identical in-phase counter-radiating apertures 5.

Those apertures are located between apertures 4 of radiator 1, coaxially and symmetrically with the radiator, while the cross-section area of high-frequency radiator 2 equals to no more than 0.7 of radiation area 4 of radiator 1.

Low-frequency band radiator 3 is located so that its acoustic axis is in the vertical plane that runs through acoustic axis of the loudspeaker. In the version of the loudspeaker being described, low-frequency radiator 3 is positioned symmetrically with middle-frequency radiator 1.

It should be noted that, besides the above described version of the loudspeaker being claimed, other specific modes of implementation of the loudspeaker and feasible which stays with the framework of the present invention. As an example, these modes may use wide-band (including coaxial) radiator heads, multi-head apertures, or two-aperture single-head structures.

The principle of operation of the loudspeaker being claimed is as follows:

Sound frequency signals produce symmetrical counter-directed oscillations of air in apertures 4 and 5 of middle-frequency and high-frequency radiators 1 and 2, respectively. Pulsing speed vector air molecules flows exited in the process collide and mutually compensate vector adiabatic excitation component in the horizontal symmetry plane of the loudspeaker, proving an azimuth symmetry and non-directivity directivity of the ration and conversion of vector flow adiabatic excitation component into scalar isotherm value, a variable concentration of particles, i.e., sonic pressure achieved in other loudspeakers only in the far zone of radiation.

Besides, vertically directed aperture 4 axes provide compensation of the Doppler intermodulation component, since the apertures are displaced normally to the directions toward the primarily listening zone. This positioning of the apertures contributes to reconstruction of mandatory reverberation components caused by reflection of the signal from floor 6 and ceiling 7, while retaining azimuth isotropism of both primary and reflected sound.

Use of low-frequency and high-frequency radiators 3 and 2, respectively, and their symmetrical positioning with respect to the middle-frequency one ensures singularity of radiation center with respect to optimal zone 8 of positioning the listeners, retaining the above mentioned advantages in an entire spectrum of the frequencies reproduced.

It should be noted that an increased quality of sound reproduced by the loudspeaker claimed dramatically reveals flaws of other components of the sound reproduction channel: intermodulation distortion in amplifiers, narrow dynamic range of sound reproduction devices, etc. Thus, a high resolution of the loudspeaker in accordance with the invention allows it to be used as a reference in comparative analysis of the sound quality of various sound reproduction channel components.

Besides, loudspeaker noise has a permanent locality which forms prerequisites for psychological disconnection of the noise.

When a low-frequency band radiator is used its design is preferably to reduce the flux component of the radiation. Dimensions of the claimed loudspeaker toward the listening zone shall be defined by the middle-frequency apertures so as to avoid overlaps toward floor 6 and ceiling 7.

Application of the loudspeaker in accordance with the invention will allow to raise the loudspeaker technology to a new level of quality.

The consumers, actually for the first time, will have an affordable possibility to reproduce, in home environment, not only the contents but also the atmosphere of the hall, a distinct "effect of presence", perception of the musical piece as it has been laid down by the director.

The loudspeaker claimed may use common, mass-produced radiators.

INDUSTRIAL APPLICABILITY

The invention may be used for high-quality sound reproduction in home, public, semi-professional and professional conditions, and in public announcement systems of airports, railway stations, in trains, ship, and similar environments which require an improved articulation under noise and interference conditions.

We claim:

1. A loudspeaker having an acoustic axis comprising:

a two-aperture radiator containing a pair of identical coaxial in-phase counter-radiating outlet apertures facing each other along a vertical plane with the distance between the apertures being equal to at least a radius of the aperture but not exceeding the wavelength of the lowest frequency reproduced by said apertures, said two-aperture radiator reproducing at least middle frequencies; a high-frequency band radiator containing paired identical coaxial in-phase counter-radiating outlet apertures located coaxially with and symmetrically between the apertures of said two-aperture radiator, the high-frequency band radiator having a cross-sectional area equal to not more than 0.7 of that of the aperture of said two-aperture radiator.

2. The loudspeaker in accordance with to claim 1, additionally comprising a low-frequency band radiator having an acoustic axis positioned in a vertical plane running through the acoustic axis of the loudspeaker.

3. The loudspeaker in accordance with to claim 2, wherein said low-frequency band radiator symmetrically with respect to said two-aperture radiator.

4. A loudspeaker having an acoustic axis comprising:

a two-aperture radiator comprising a pair of identical coaxial in-phase counter-radiating apertures facing each other, the apertures having vertical axes with the distance between the apertures being equal to at least a radius of the aperture but not exceeding the wavelength of the lowest frequency reproduced by said apertures, said two-aperture radiator reproducing at least middle frequencies; and a high-frequency band radiator containing paired identical coaxial in-phase counter-radiating apertures located coaxially with and symmetrically between the apertures of said two-aperture radiator, the high-frequency band radiators having a cross-sectional area equal to not more than 0.7 of that of the aperture of said two-aperture radiator.

5. The loudspeaker in accordance with claim 4, additionally comprising a low-frequency band radiator having an acoustic axis, the low-frequency band radiator positioned in a vertical plane running through the acoustic axis of the loudspeaker.

6. The loudspeaker in accordance with to claim 5, wherein said low-frequency band radiator is positioned symmetrically with respect to said two-aperture radiator.

* * * * *